US008358264B2

(12) United States Patent
Nose et al.

(10) Patent No.: US 8,358,264 B2
(45) Date of Patent: Jan. 22, 2013

(54) BACKLIGHT BRIGHTNESS CONTROL FOR PANEL DISPLAY DEVICE INCLUDING CONTROLLING A BRIGHTNESS OF THE BACKLIGHT TO HAVE A VARIABLE BRIGHTNESS IN A PORTION OF A PERIOD

(75) Inventors: Takashi Nose, Kanagawa (JP); Hirobumi Furihata, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 354 days.

(21) Appl. No.: 12/654,268

(22) Filed: Dec. 15, 2009

(65) Prior Publication Data

US 2010/0164922 A1 Jul. 1, 2010

(30) Foreign Application Priority Data

Dec. 16, 2008 (JP) ..... 2008-319692

(51) Int. Cl.
*G09G 3/36* (2006.01)

(52) U.S. Cl. ..... 345/102; 345/691

(58) Field of Classification Search ..... 345/102, 345/690, 691

See application file for complete search history.

(56) References Cited

U.S. PATENT DOCUMENTS

| | | | | |
|---|---|---|---|---|
| 7,053,871 | B2 * | 5/2006 | Tomida et al. | 345/60 |
| 7,450,104 | B2 | 11/2008 | Baik | |
| 2003/0210221 | A1 * | 11/2003 | Aleksic | 345/102 |
| 2006/0103612 | A1 * | 5/2006 | Ozaki | 345/83 |
| 2006/0187181 | A1 * | 8/2006 | Kim | 345/102 |
| 2007/0247415 | A1 | 10/2007 | Yasunaga | |
| 2008/0055231 | A1 * | 3/2008 | Nose et al. | 345/102 |

FOREIGN PATENT DOCUMENTS

| | | |
|---|---|---|
| JP | 2003-161926 | 6/2003 |
| JP | 2005-148708 | 6/2005 |
| JP | 2007-286501 A | 11/2007 |
| JP | 2008-084296 A | 4/2008 |

OTHER PUBLICATIONS

Japanese Office Action dated Sep. 13, 2012 with English Translation.

* cited by examiner

*Primary Examiner* — Chanh Nguyen
*Assistant Examiner* — Kwang-Su Yang
(74) *Attorney, Agent, or Firm* — McGinn IP Law Group, PLLC

(57) ABSTRACT

A display device is provided with a display panel, a backlight which illuminates the display panel, and a backlight brightness controller controlling a brightness of the backlight so that the brightness of the backlight is variable in the middle of each frame period.

7 Claims, 8 Drawing Sheets

BACKLIGHT BRIGHTNESS CONTROL FOR PANEL DISPLAY DEVICE INCLUDING CONTROLLING A BRIGHTNESS OF THE BACKLIGHT TO HAVE A VARIABLE BRIGHTNESS IN A PORTION OF A PERIOD

INCORPORATION BY REFERENCE

This application claims the benefit of priority based on Japanese Patent Application No. 2008-319692, filed on Dec. 16, 2008, the disclosure of which is incorporated herein by reference.

BACKGROUND OF THE INVENTION

1. Field of the Invention

The present invention relates to a display device, a display panel driver, and a backlight drive method, and especially relates to a brightness control of backlight of the display device.

2. Description of the Related Art

One problem in recent LCD (liquid crystal display) devices, specifically LCD devices mounted on portable terminals, is increased power consumption. As the LCD panel has grown in size with improved resolution, the power consumption of the liquid crystal display increases year by year. The backlight is a large consumer of power, and accordingly reduction of the power consumption of the backlight is an effective means for reduction of the total power consumption of the liquid crystal display.

Optimization of brightness control of the backlight is one effective approach to reduce the power consumption of the backlight without deteriorating the image quality. Reduction of the backlight brightness in displaying a dark image effectively reduces the power consumption without deterioration the image quality. Meanwhile, the power consumption can be reduced by lowering the backlight brightness when the liquid crystal display device is used in a dark environment. In addition, recent cellular phones have a function of setting the backlight brightness in accordance with a user setting, which suppresses the power consumption of the backlight. For example, Japanese Laid Open Patent Application No. P2005-148708A discloses a technique to control the backlight brightness on the basis of the picture level of the display image, that is, values of image data of each frame. Furthermore, Japanese Laid Open Patent Application No. 2003-161926 discloses a technique to control the backlight brightness on the basis of the lightness of a use environment (that is, environment light intensity).

One issue in optimization of the brightness control of the backlight is limitation of the number of adjustment steps of the backlight brightness. In commonly-used backlight drive circuits (for example, LED drivers for LED (Light Emitting Diode) backlights), the number of adjustment steps of the backlight brightness is specified in the specification. More specifically, a PWM signal whose duty ratio is variable in 256 steps is generated by a brightness control circuit, and the backlight drive circuit is configured to drive the backlight in brightness in accordance with the duty ratio of the generated PWM signal. Accordingly, the brightness control circuit is configured to control the backlight brightness by 8-bit data. However, the adjustment in 256 steps may be insufficient for a specific control algorithm of the backlight brightness.

Let us consider the following control algorithm as one example:

(1) 8-bit backlight brightness data are used to specify the backlight brightness; and (2) the allowed range of the backlight brightness data is determined depending on the environment light intensity, and the backlight brightness data are determined within the determined range on the basis of the picture level.

When the environment light intensity is high (that is, when the use environment is bright), the maximum backlight brightness is increased and the allowed range of the backlight brightness data is widened accordingly. On the other hand, when the environment light intensity is low (when the use environment is dark), the maximum backlight brightness needs to be reduced and thus the allowed range of the backlight brightness data is narrowed. This undesirably leads to reduction in the number of adjustment steps of the backlight brightness for the dark use environment.

When the number of adjustment steps of the backlight brightness, which depends on the environment light intensity, is reduced below the number of steps necessary for providing desired picture contrast, the backlight brightness is not suitably controlled on the picture level. When the picture level is represented by 6-bit data, for example, the number of adjustment steps of the backlight brightness is required to be at least 64. However, when the number of adjustment steps of the backlight brightness, which depends on the environment light intensity, becomes smaller than 64, the backlight brightness may be improperly controlled based on the picture level.

To handle such problem, the backlight drive circuit and the brightness control circuit for controlling the drive circuit need to be configured so that the backlight brightness can be adjusted in more steps. When the backlight brightness can be adjusted in many steps, the shortage of the number of adjustment steps of the backlight brightness does not occur.

One approach may be to configure the brightness control circuit so as to generate the PWM signal whose duty ratio can be changed in many steps (for example, 1024 steps), and to configure the backlight drive circuit so as to be adapted the PWM signal that is variable in many steps. However, such approach undesirably increases the circuit size. In order to generate the PWM signal whose duty ratio is variable with many steps, the brightness control circuit needs to be configured to handle multi-bit control data. This increases the circuit size of the brightness control circuit. In addition, the circuit size of the backlight drive circuit is undesirably increased when the backlight drive circuit is configured so as to process the PWM signal that is variable in multiple steps.

SUMMARY OF THE INVENTION

In an aspect of the present invention, a display device is provided with a display panel, a backlight which illuminates the display panel, and a backlight brightness controller controlling the backlight brightness so that the backlight brightness is variable in the middle of each frame period.

When the backlight brightness is changed in the middle of each frame period, the backlight brightness actually perceived by the human eyes is the average of the backlight brightness in each frame period. Therefore, intermediate levels of the backlight brightness are virtually achieved by controlling backlight brightness in the middle of each frame period. This approach allows increasing the number of the effective adjustment steps of the backlight brightness with reduced circuit size.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Figure 1:
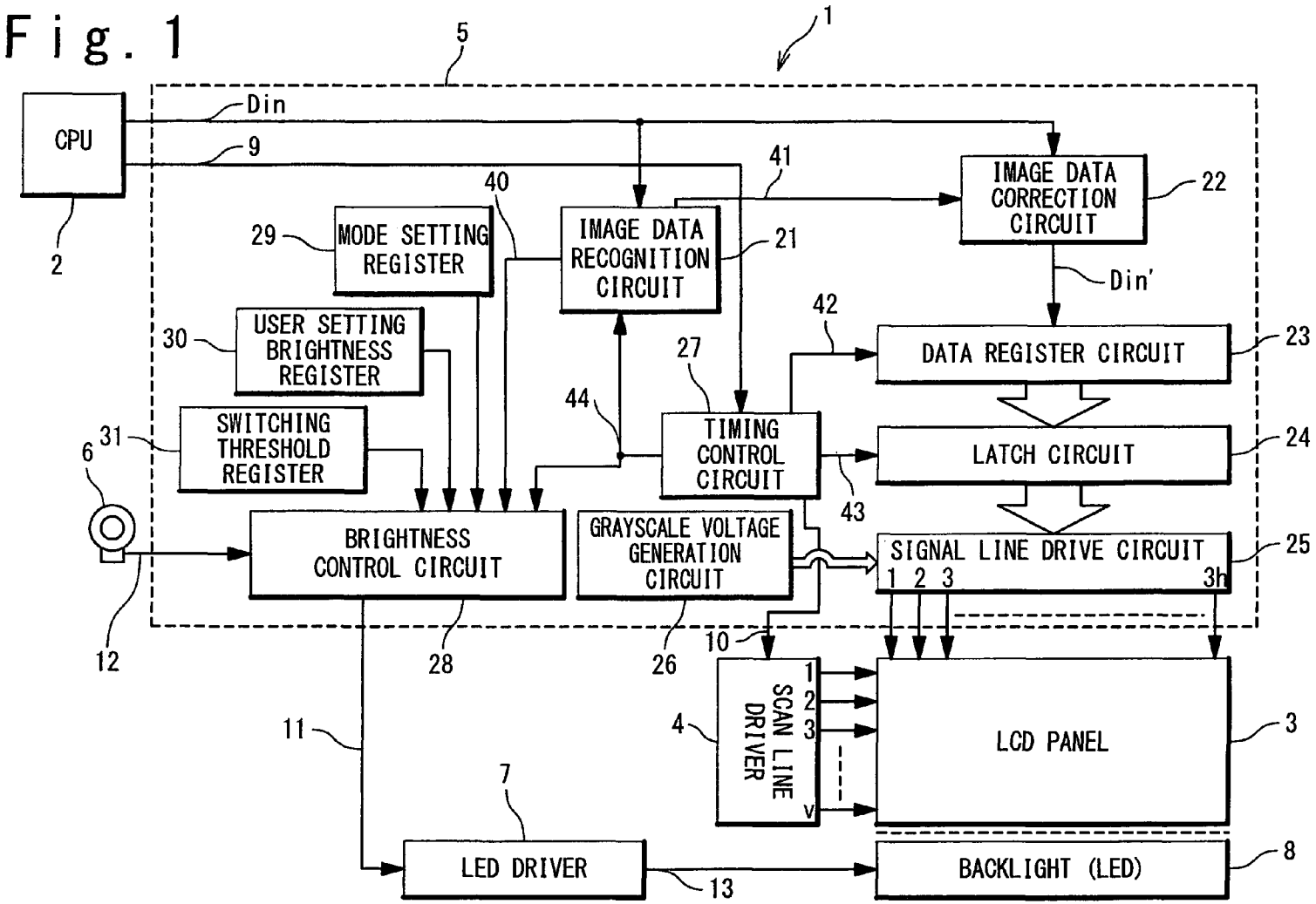
FIG. 1 is a block diagram showing an exemplary configuration of a liquid crystal device in one embodiment of the present invention.

FIG. 1 is a block diagram showing an exemplary configuration of a liquid crystal display device 1 in one embodiment of the present invention. The liquid crystal display device 1 is configured to display an image in accordance with image data Din supplied from a CPU (Central Processing Unit) 2, and includes an LCD (Liquid Crystal Display) panel 3, a scan line driver 4, an LCD driver 5, an environment light sensor 6, an LED (Light Emitting Diode) driver 7, and a backlight 8. In this embodiment, the backlight 8 includes an LED and a light guide, and illuminates the LCD panel 3.

The LCD panel 3 includes signal lines (or data lines), scan lines (or gate lines), and liquid crystal pixels arranged at the intersections thereof. The scan line driver 4 drives the scan lines within the LCD panel 3. The scan line driver 4 may be mounted as an IC (Integrated Circuit) separated from the LCD panel 3, or integrated within the LCD panel 3 by using a COG (Circuit on Glass) technique.

The LCD driver 5 has following three functions. Firstly, the LCD driver 5 drives the signal lines of the LCD panel 3 in response to image data Din and synchronization signals 9 fed from the CPU 2. Secondary, the LCD driver 5 generates a scan line drive timing control signal 10 to control the operation timing of the scan line driver 4. Furthermore, the LCD driver 5 generates a brightness control signal 11 to control the brightness of the backlight 8. As will be described below, the brightness control signal 11 is generated as a pulse signal through a PWM (Pulse Width Modulation) technique, and the brightness of the backlight 8 is controlled on the duty ratio of the brightness control signal 11. When the duty ratio of the brightness control signal 11 is 100%, the backlight brightness becomes the highest, and when the duty ratio of the brightness control signal 11 is 0%, the backlight brightness becomes zero.

The environment light sensor 6 is used to measure the environment light intensity in the environment where the liquid crystal display 1 is used. The environment light sensor 6 generates an environment light intensity signal 12 having a signal level corresponding to the intensity of the environment light incident on the environment light sensor 6, and supplies the environment light intensity signal 12 to the LCD driver 5. The LCD driver 5 controls the backlight brightness in response to the environment light intensity signal 12.

The LED driver 7 is a backlight drive circuit which generates a drive electric current 13 in response to the brightness control signal 11 supplied from the LCD driver 5 and supplies the generated drive electric current 13 to the backlight 8. The current level of the drive electric current 13 is controlled depending on the duty ratio of the brightness control signal 11. Most simply, the drive electric current 13 of a predetermined current level is supplied to the backlight 8 when the brightness control signal 11 is set to the "High" level, and the supply of the drive electric current 13 is stopped while the brightness control signal 11 is set to the "Low" level. Such control achieves control of the brightness of the backlight 8 depending on the duty ratio of the brightness control signal 11. When the LED driver 7 is configured so as to detect the duty ratio of the brightness control signal 11, the electric current level of the drive electric current 13 may be controlled depending on the detected duty ratio. The presently most-common LED driver is configured to accept a 256-level duty ratio. That is, the number of adjustment steps of the backlight brightness is 256 in general. In the following description, an explanation will be made assuming that the LED driver 7 accepts the brightness control signal 11 whose duty ratio is variable in 256 steps.

The LCD driver 5 includes an image data recognition circuit 21, an image data correction circuit 22, a data register circuit 23, a latch circuit 24, a signal line drive circuit 25, a grayscale voltage generation circuit 26, a timing control circuit 27, and a brightness control circuit 28.

The image data recognition circuit 21 recognizes feature of an image displayed on the LCD panel 3 on the basis of the image data Din supplied from the CPU 2. In this embodiment, the image data recognition circuit 21 detects the picture level of the each frame image and other features of the frame image, generates an image correction signal 41 for instructing how the image data Din have to be corrected, and supplies the image correction signal 41 to the image data correction circuit 22. In this embodiment, the image data recognition circuit 21 calculates the APL (Average Picture Level) of each frame image, and supplies an APL signal 40 indicating the calculated APL. The APL is the average value of the grayscale levels of all the pixels in the frame image of interest. As described below, the calculated APL is used for controlling the brightness of the backlight 8.

The image data correction circuit 22 corrects the image data Din in accordance with the image correction signal 41 so that the image is optimized for the brightness of the backlight 8 determined by the brightness control circuit 28. The image data Din corrected by the image data correction circuit 22 are referred to as corrected image data Din', hereinafter.

The data register circuit 23 sequentially receives the corrected image data Din' from the image data correction circuit 22 and temporarily stores the received image data Din'. The data register circuit 23 has a capacity to store the corrected image data Din' for one horizontal line, and receives the corrected image data Din' in synchronization with a register signal 42 supplied from the timing control circuit 27.

The latch circuit 24 latches the corrected image data Din' of one horizontal line from the data register circuit 23 at the same time in response to the latch signal 43 supplied from the timing control circuit 27, and transfers the latched corrected image data Din' to the signal line drive circuit 25.

The signal line drive circuit 25 drives the signal lines of the LCD panel 3 in response to the correction image data Din' of one horizontal line sent from the latch circuit 24. More specifically, in response to the corrected image data Din', the signal line drive circuit 25 selects the corresponding grayscale voltage from among a set of grayscale voltages $V_1$ to $V_N$ supplied from the grayscale voltage generation circuit 26, and drives the signal line of the LCD panel 3 in the selected gradation voltage.

The timing control circuit 27 carries out the timing control of the liquid crystal display device 1 in response to the synchronization signal 9 sent from the CPU 2. More specifically, the timing control circuit 27 supplies the register signal 42 and the latch signal 43 to the data register circuit 23 and the latch circuit 24, respectively, and controls the timing to transfer the corrected image data Din' to the data register 23 and the latch circuit 24. In addition, the timing control circuit 27 generates the scan line drive timing control signal 10, and controls the operation timing of the scan line driver 4. Moreover, the timing control circuit 27 supplies the frame signal 44 to the image data recognition circuit 21 and the brightness control circuit 28. The image data recognition circuit 21 and the brightness control circuit 28 recognize the initiation of each frame period on the basis of the frame signal 44.

The brightness control circuit 28 generates the brightness control signal 11 used for controlling the brightness of the backlight 8 in response to the APL signal 40 supplied from the image data recognition circuit 21 and the environment light intensity signal 12 supplied from the environment light sensor 6. Specifically, in controlling the brightness of the backlight 8 in a certain frame period, the brightness control circuit 28 controls the brightness of the backlight 8 in response to the APL in the previous frame period indicated by the APL signal 40 and the current environment light intensity indicated by the environment light intensity signal 12. As described above, the brightness control signal 11 is generated as a pulse signal by the PWM technique, and the brightness of the backlight 8 is controlled on the basis of the duty ratio of the brightness control signal 11.

In this embodiment, the brightness control circuit 28 is configured so that the brightness of the backlight 8 is variable in the middle of each frame period. Specifically, the brightness control circuit 28 is configured so that the duty ratio of the brightness control signal 11 is controlled in the middle of each frame period to thereby control the brightness of the backlight 8 in the middle of each frame period.

Figure 2:
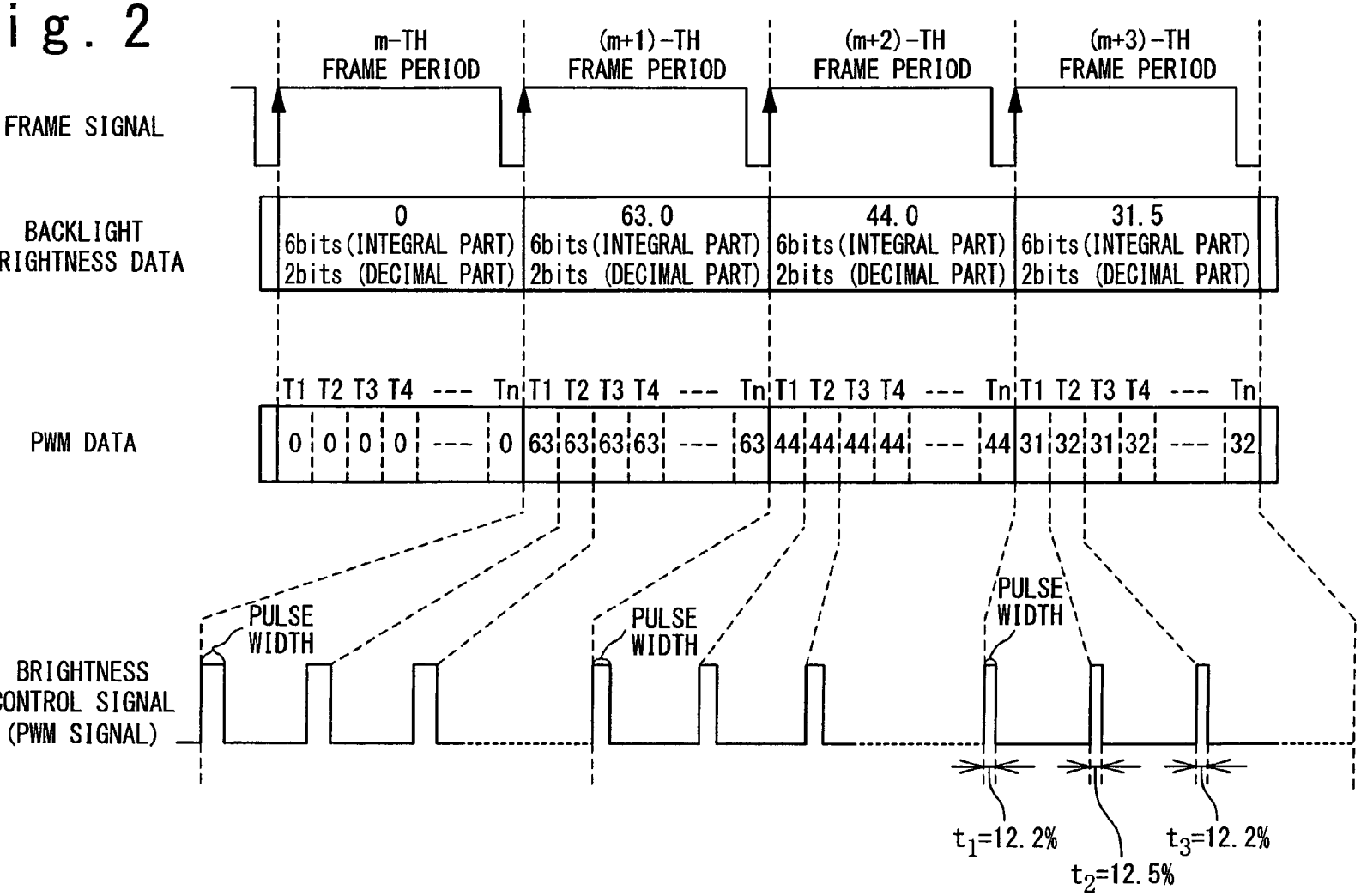
FIG. 2 is a timing chart showing backlight brightness control under which the duty ratio of a brightness control signal is variable in the middle of a frame period.

FIG. 2 is a timing chart showing an exemplary brightness control of the backlight 8. The brightness control circuit 28 generates backlight brightness data used for specifying the brightness of the backlight 8 for the whole frame period in each frame period. In addition, each frame period is divided into a plurality of sub-frame periods T1 to Tn, and the brightness control circuit 28 sets PWM data which specify the duty ratios of the brightness control signal 11 in the respective sub-frame periods T1 to Tn. The PWM data are allowed to be variable in the middle of each frame period. The values of the PWM data in the respective sub-frame periods of a certain frame period are generated so that the average of the PWM data is equal to the value of the backlight brightness data in the frame period. For example, in the operation in the (m+3)-th sub-frame period of FIG. 2, the PWM data are set to 31 in odd-numbered sub-frame periods and set to 32 in even-numbered sub-frame periods on the basis of the fact the backlight brightness data are set to 31.5.

The duty ratio of the brightness control signal 11 is controlled on the PWM data thus generated. For example, when the PWM data are set to 31, the duty ratio of the brightness control signal 11 is controlled to 12.2% (=31/255), and when the PWM data is set to 32, the duty ratio of the brightness control signal 11 is controlled to 12.5% (=32/255). When the PWM data are constant during the instant frame period (as in the m-th to (m+2)-th frame periods), the duty ratio of the brightness control signal 11 is constant in the instant frame period, and accordingly the brightness of the backlight 8 is also constant in the instant frame period. Meanwhile, when the PWM data are set to 31 in the odd-numbered sub-frame periods and set to 32 in the even-numbered sub-frame periods as in the (m+3)-th sub-frame period, the duty ratio of the brightness control signal 11 is controlled to 12.2% (=31/255) in the odd-numbered sub-frame periods and to 12.5% (=32/255) in the even-numbered sub-frame periods. In this manner, the brightness of the backlight 8 can be controlled to be "31.5" by changing the duty ratio of the brightness control signal 11, as indicated by the backlight brightness data.

In such control method, the brightness of the backlight 8 can be controlled in an increased number of steps, suppressing an increase in the number of adjustment steps of the duty ratio of the brightness control signal 11. For example, even when the number of adjustment steps of the duty ratio of the brightness control signal 11 is 256, the brightness of the backlight 8 can be controlled in the number of adjustment steps or more (for example, 1024 steps). This increases the number of adjustment steps of the brightness of the backlight 8, suppressing increase of circuit scales of the brightness control circuit 28 and the LED driver 7.

In the following, a description is given of an exemplary operation of the liquid crystal display 1 in which the brightness of the backlight 8 is variable in the middle of each frame period. In this example, a mode setting resister 29 is prepared in the LCD driver 5, and the LCD driver 5 is set to any one of the following four control modes depending on the set value of the mode setting resister 29:

(1) User setting mode,
(2) Picture level control mode,
(3) Environment level control mode, and
(4) Picture level/environment level control mode.

Here, the user setting mode is a control mode for controlling the brightness of the backlight 8 on the set value set by the user. In this example, a user setting brightness register 30 is prepared in the LCD driver 5, and the brightness of the backlight 8 is controlled on the set value of the user setting brightness register 30. The picture level control mode is a control mode for controlling the brightness of the backlight 8 on the picture level of the displayed image. As described above, in the operational example, the brightness of the backlight 8 in a certain frame period is controlled on the APL of the image in the frame period just before the certain frame period. The environment level control mode is a control mode for controlling the brightness of the backlight 8 on the environment light intensity. In this example, the brightness of the backlight 8 is controlled on the environment light intensity signal 12 generated by the environment light sensor 6. Lastly, the picture level/environment level control mode is a control mode for controlling the brightness of the backlight 8 on both of the picture level of the displayed image (the APL in this embodiment) and the environment light intensity. As described below, the control for setting the brightness of the backlight 8 to be variable in the middle of each of the frame periods is employed in the picture level/environment level control mode. In the operation of the LCD driver 5 in the picture level/environment level control mode, a switching threshold value set by a switching threshold register 31 is used.

In the following, descriptions are given of the above-mentioned four control modes (1) to (4). The descriptions are given assuming that both of the backlight brightness data used for specifying the brightness of the backlight 8 throughout the whole frame period and the PWM data used for specifying the duty ratio of the brightness control signal 11 are 8-bit data. However, it would be apparent to the person skilled in the art that the number of bits of the backlight brightness data and the PWM data are not limited to eight.

(1) User Setting Mode

When the LCD driver 5 is placed into the user setting mode, the brightness control circuit 28 uses the set value of the user setting brightness register 30 as the backlight brightness data. In addition, the brightness control circuit 28 sets the PWM data to the value corresponding to the backlight brightness data, and further sets the duty ratio of the brightness control signal 11 in accordance with the PWM data. When the set value of the user setting brightness register 30 is 255, for example, the backlight brightness data are set to 255 and further the PWM data are set to 255. In this manner, the duty ratio of the brightness control signal 11 is set to 100% (=255/255×100%). When the set value of the user setting brightness register 30 is 179, the backlight brightness data is set to 179 and further the PWM data is set to 179. As a result, the duty ratio of the brightness control signal 11 is set to 70.2% (=179/255×100%). In this manner, the backlight 8 is driven with the desired brightness. When the LCD driver 5 is placed into the user setting mode, the PWM data, that is, the duty ratio of the brightness control signal 11 are constant during each frame period.

(2) Picture Level Control Mode

When the LCD driver 5 is placed into the picture level control mode, the brightness control circuit 28 determines the backlight brightness data in response to the APL indicated in the APL signal 40 and sets the PWM data to the value corresponding to the backlight brightness data; in the picture level control mode, the brightness of the backlight 8 is controlled independently of the environment light intensity. In the picture level control mode, the backlight bright data is calculated as values of 0 to 255.

Figure 3:
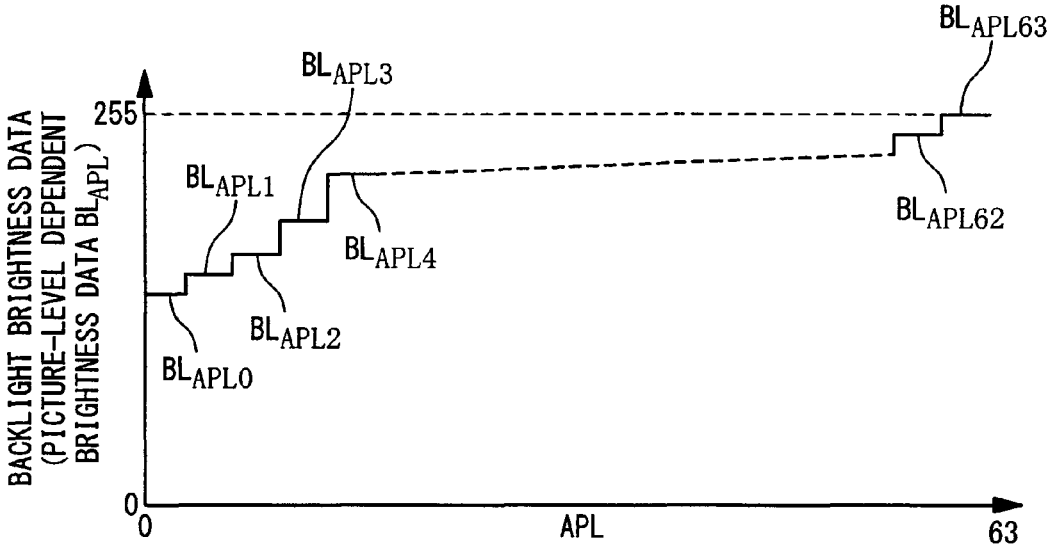
FIG. 3 is a graph showing the association of the APL with backlight brightness data in a picture level control mode.

FIG. 3 is a diagram conceptually showing the association of the APL with the backlight brightness data in the picture level control mode. As the APL calculated in the image data recognition circuit 21 is increased, the backlight brightness data is also increased to increase the brightness of the backlight 8. It should be noted that FIG. 3 illustrates the association of the APL with the backlight brightness data for the case where the value of the APL is represented as 6-bit data, wherein the value of the backlight brightness data for the case where the value of the APL is x is denoted by the symbol $B_{APLx}$. The PWM data are set to the same value as that of the backlight brightness data, and accordingly the duty ratio of the brightness control signal 11 is set to the corresponding desired value.

Figure 4:
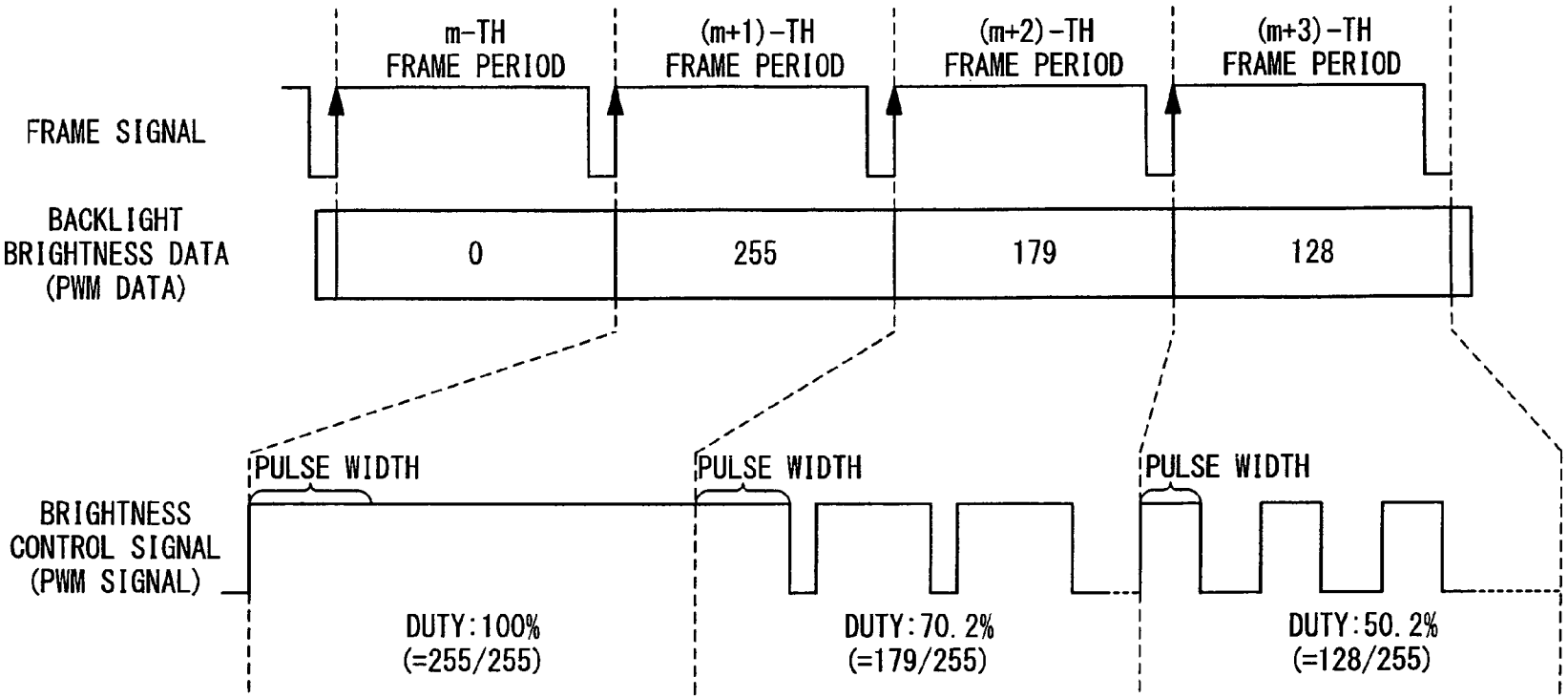
FIG. 4 is a timing chart showing backlight control in the picture level control mode.

FIG. 4 shows an exemplary operation of the LCD driver 5 for a case where the LCD driver 5 is placed into the picture level control mode, and especially shows the association of the values of the backlight brightness data and the PWM data with the waveform of the brightness control signal 11. FIG. 4 is shown presuming that each frame period begins with a pull-up of the frame signal 44. The brightness of the backlight 8 in each frame period is set in response to the backlight brightness data (that is, the PWM data). For example, when the backlight brightness data are set to 179 in response to the APL, the PWM data are also set to 179, and accordingly the duty ratio of the brightness control signal 11 is set to 70.2% (=179/255×100%). In this manner, the backlight 8 is driven with the desired brightness. In FIG. 4, the duty ratio of the brightness control signal 11 is constant during each frame period; the brightness of the backlight 8 is constant during each frame period.

(3) Environment level control mode

When the LCD driver 5 is placed into the environment level control mode, the brightness control circuit 28 determines the backlight brightness data in response to the environment light intensity signal 12 supplied from the environment light sensor 6 and sets the PWM data to the value corresponding to the backlight brightness data; in the environment level control mode, the brightness of the backlight 8 is controlled independently of the picture level of the displayed image. Similarly to the picture level control mode, the backlight bright data is calculated as values of 0 to 255 in the environment level control mode.

Figure 5:
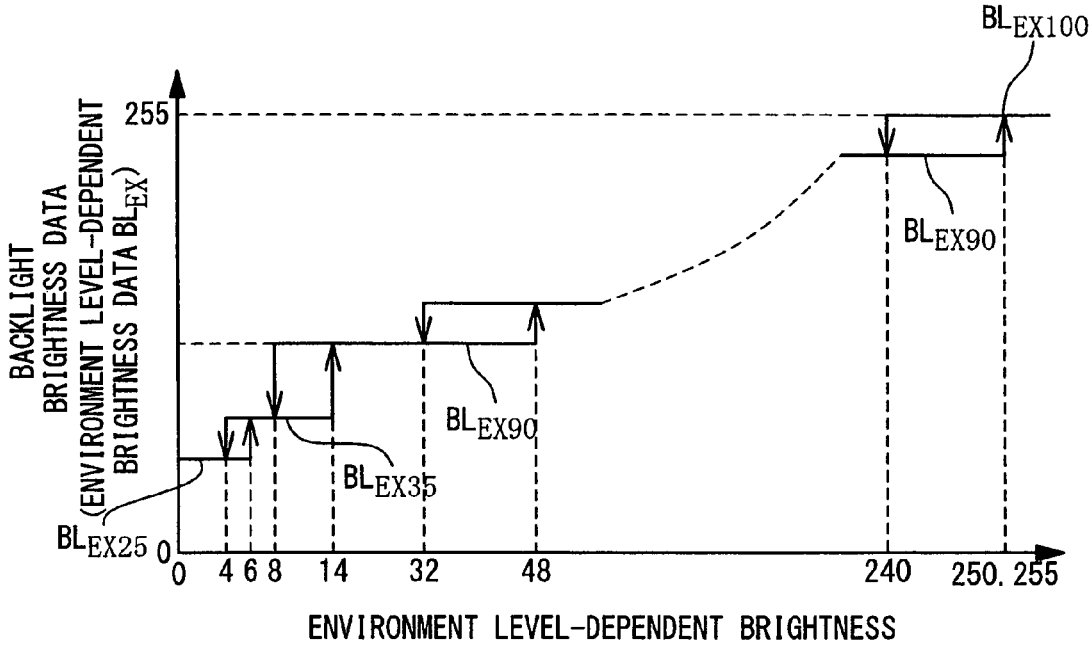
FIG. 5 is a graph showing the association of the environment light intensity with the backlight brightness data in an environment level control mode.

FIG. 5 is a diagram conceptually showing the association of the environment light intensity with the backlight brightness data in the environment level control mode. The brightness control circuit 28 recognizes the environment light intensity from the signal level of the environment light intensity signal 12. Shown in FIG. 5 is the association of the environment light intensity with the backlight brightness data for the case where the environment light intensity is represented as 8-bit data. As the environment light intensity is increased, the value of the backlight brightness data is also increased to increase the brightness of the backlight 8. In order to prevent the brightness of the backlight 8 from being unstable because of small fluctuation of the environment light intensity, a hysteresis property is introduced in the association of the environment light intensity with the backlight brightness data. That is, the association of the environment light intensity and the backlight brightness data for the case the environment light intensity is increasing is different from that for the case where the environment light intensity is decreasing.

Figure 6:
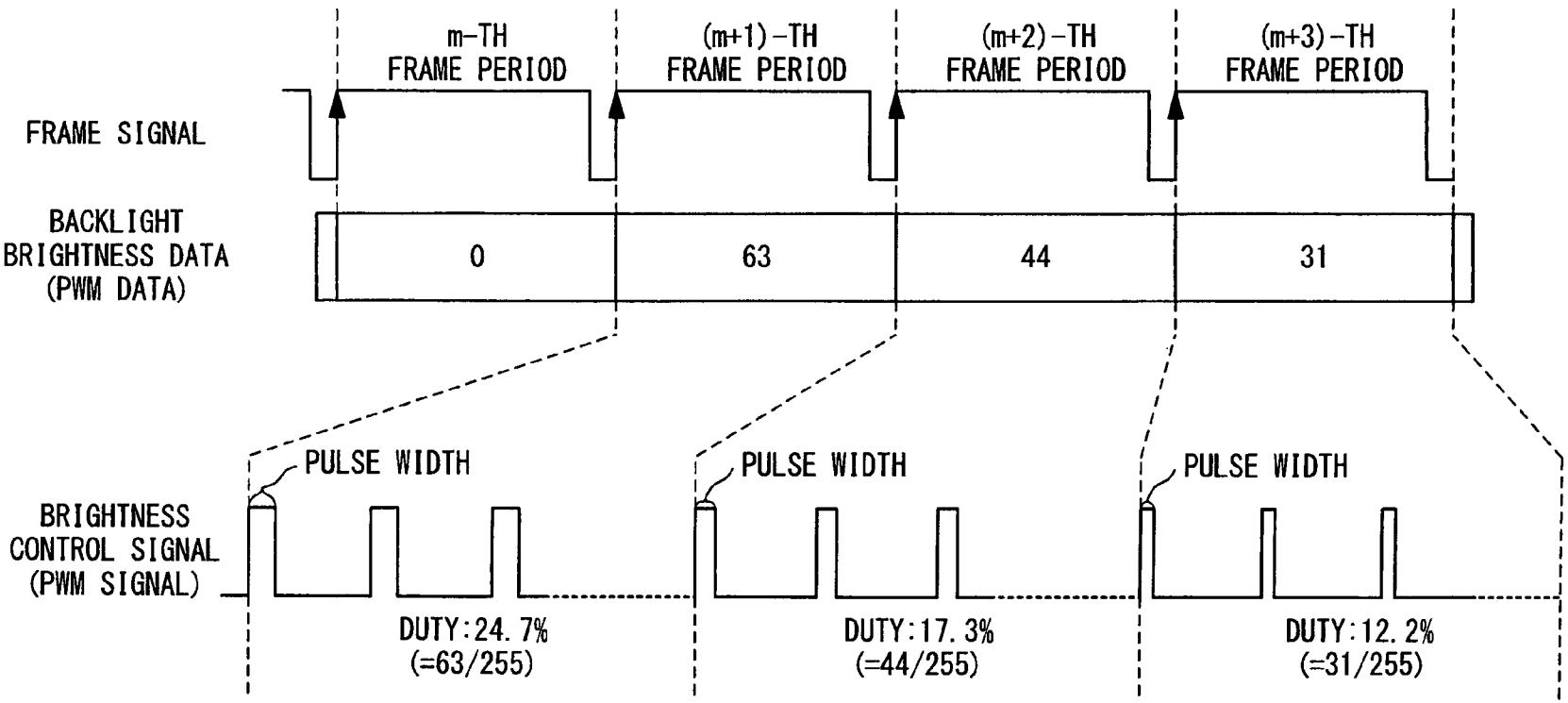
FIG. 6 is a timing chart showing the backlight control of the in the environment level control mode.

Also in the environment level control mode, the PWM data are set to the same value as that of the backlight brightness data, and accordingly the duty ratio of the brightness control signal 11 is set to the desired value. FIG. 6 shows an exemplary operation of the LCD driver 5 when the LCD driver 5 is placed into the environment level control mode, and especially shows the association of the backlight brightness data and the PWM data with the waveform of the brightness control signal 11. When the backlight brightness data is set to 44 on the basis of the environment light intensity, for example, the PWM data are also set to 44, and accordingly the duty ratio of the brightness control signal 11 is set to 17.3% (=44/255×100%). In this manner, the backlight 8 is driven with desired brightness. Similarly to FIG. 4, the duty ratio of the brightness control signal 11 is constant during each frame period in FIG. 6; the brightness of the backlight 8 is constant in each frame period.

(4) Picture level/Environment Level Control Mode

When the LCD driver 5 is place into the picture level/environment level control mode, the brightness control circuit 28 determines the backlight brightness data and the PWM data in response to the APL indicated by the APL signal 40 and the environment light intensity indicated by the environment light intensity signal 12. More specifically, the backlight brightness data are determined on the basis of the APL in the same manner as in the picture level control mode, and additionally the backlight brightness data are determined on the basis of the environment light intensity in the same manner as in the environment level control mode. In order to distinguish these backlight brightness data, the backlight brightness data determined on the APL are referred to as "picture-level-dependent brightness data $BL_{APL}$" and the backlight brightness data determined on the environment light intensity are referred to as "environment-level-dependent brightness data $BL_{EX}$", hereinafter.

The backlight brightness data BL finally used for a control of the brightness of the backlight 8 are calculated from the picture-level-dependent brightness data $BL_{APL}$ and the environment-level-dependent brightness data $BL_{EX}$. The environment-level-dependent brightness data $BL_{EX}$ are used for determining an allowed maximum value $BL_{MAX}$ of the backlight brightness data BL to be finally determined. The allowed maximum value $BL_{MAX}$ of the backlight brightness data BL is determined so as to be increased as the environment-level-dependent brightness data $BL_{EX}$ is increased. Meanwhile, the picture-level-dependent brightness data $BL_{APL}$ is used for determining the ratio of the value of the backlight brightness data BL to the allowed maximum value $BL_{MAX}$. That is, the backlight brightness data BL, which are finally used for the control of the brightness of the backlight 8, are determined by the following formula:

$$BL=BL_{MAX}\cdot(BL_{APL}/255). \quad (1).$$

In the simplest manner, the allowed maximum value $BL_{MAX}$ of the backlight brightness data BL is set to the same value as the environment-level-dependent brightness data $BL_{EX}$. In other words, it holds:

$$BL=BL_{EX}\cdot(BL_{APL}/255). \quad (1)'.$$

Figure 7:
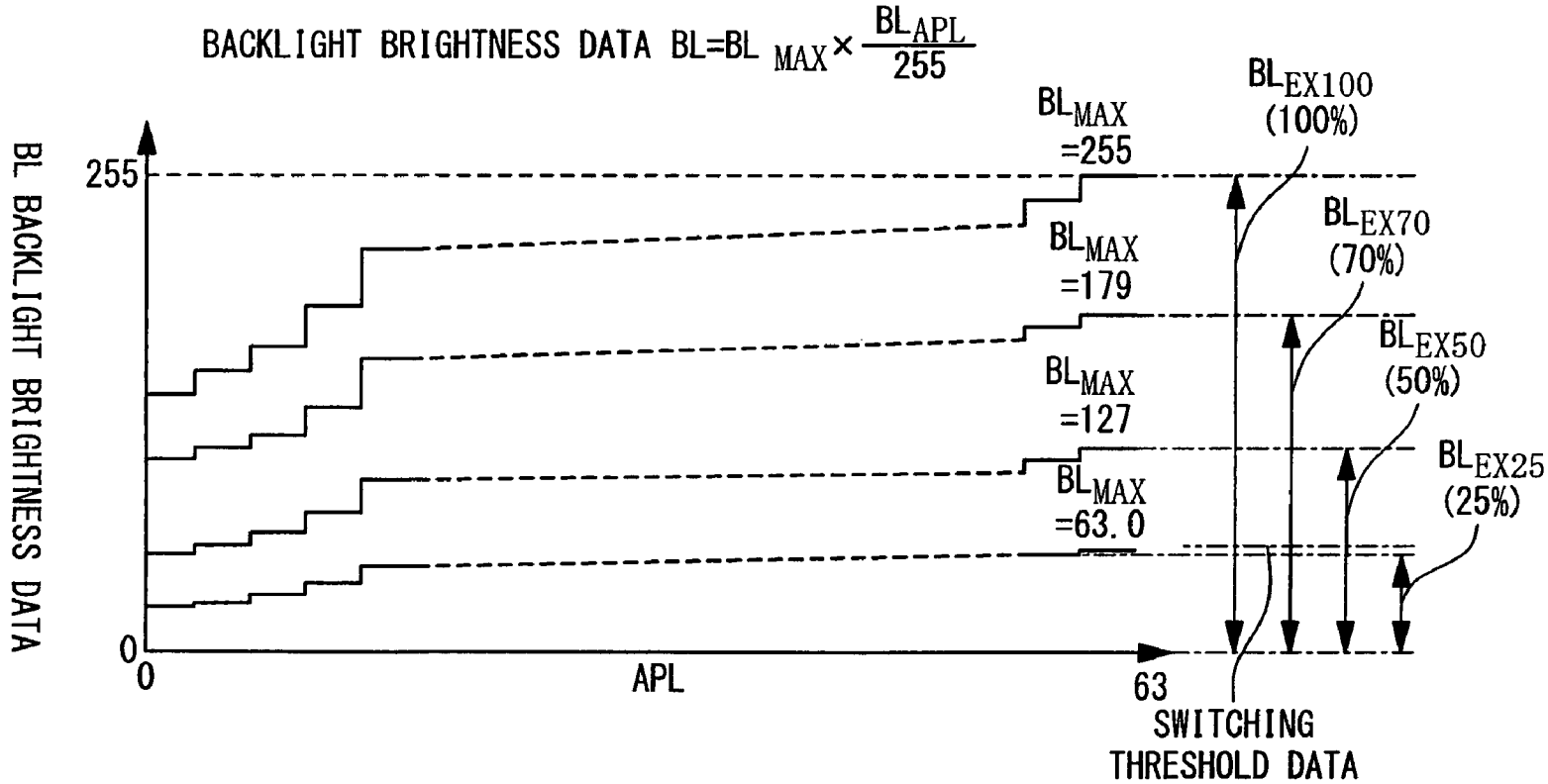
FIG. 7 is a graph showing the association of the APL and the backlight brightness data in a picture level/environment light intensity brightness mode.

FIG. 7 is a graph showing the association of the APL of the displayed image with the backlight brightness data BL, which is represented by the formula (1). As shown in FIG. 7, the allowed maximum value $BL_{MAX}$ of the backlight brightness data BL is increased as the environment light intensity is (that is, the value of the environment-level-dependent brightness data $BL_{EX}$) increased. In addition, the value of the backlight brightness data BL to be finally calculated is increased as the APL (that is, the value of the picture-level-dependent brightness data $BL_{APL}$) is increased.

The PWM data are calculated from the backlight brightness data BL calculated in this manner, the duty ratio of the brightness control signal 11 is additionally determined depending on the calculated PWM data, and accordingly the brightness of the backlight 8 is controlled.

The calculation method of the backlight brightness data BL and the PWM data is switched on the basis of comparison of the value of the allowed maximum value $BL_{MAX}$ of the backlight brightness data BL with the switching threshold value set in the switching threshold data register 31. When the allowed maximum value $BL_{MAX}$ of the backlight brightness data BL is equal to the environment-level-dependent brightness data $BL_{EX}$, the calculation methods of the backlight brightness data BL and the PWM data are switched on the basis of the comparison of the environment-level-dependent brightness data $BL_{EX}$ with the switching threshold value.

When the allowed maximum value $BL_{MAX}$ of the backlight brightness data BL is larger than the switching threshold value, the brightness control signal 11 is generated so that the duty ratio is constant during each frame period (that is, so that the brightness of the backlight 8 is constant during each frame period) in the same manner, as in the picture level control mode and the environment level control mode.

Specifically, the backlight brightness data BL are calculated as values of 0 to 255 (which include no decimal part) according to the formula (1) or (1)' in the same manner as in the picture level control mode and the environment level control mode. It should be noted that all bits of the backlight brightness data BL are allocated to the integral part. FIG. 7 shows the association of the APL with the backlight brightness data BL when the value of the allowed maximum value $BL_{MAX}$ of the backlight brightness data BL is 255, 179, or 127. The PWM data are set to the same value as the backlight brightness data BL. The duty ratio of the brightness control signal 11 is controlled on the value of the PWM data, and thus the backlight 8 is controlled to desired brightness.

Also in this case, the duty ratio of the brightness control signal 11 is constant during each frame period, that is, the brightness of the backlight 8 is constant during each frame period. When the allowed maximum value $BL_{MAX}$ of the backlight brightness data BL (that is, a value of the environment-level-dependent brightness data $BL_{EX}$) is large, the number of adjustment steps of the brightness of the backlight 8 is sufficiently large, and accordingly no special control is required.

Meanwhile, when the value of the allowed maximum value $BL_{MAX}$ of the backlight brightness data BL is equal to or smaller than the switching threshold, the brightness control signal 11 is generated so that the duty ratio is variable in the middle of each frame period (that is, so that the brightness of the backlight 8 is variable in the middle of each frame period). As described above, when the allowed maximum value $BL_{MAX}$ of the backlight brightness data BL is small, the number of adjustment steps of the brightness of the backlight 8 may be insufficient. In order to avoid this problem, a control is implemented in which the brightness of the backlight 8 is variable in the middle of each frame period when the value of the allowed maximum value $BL_{MAX}$ of the backlight brightness data BL is equal to or less than the switching threshold, and thereby the number of adjustment steps of the brightness of the backlight 8 is virtually increased.

In detail, the backlight brightness data BL is calculated as values of 0.0 to 63.0 in steps of 0.25 in accordance with the formula (1) or (1)'. It should be noted that the backlight brightness data BL to be calculated includes not only the integral part but also the decimal part. Upper six bits of the backlight brightness data BL are allocated to the integral part, and the lower two bits are allocated to the decimal part. FIG. 7 shows the association of the APL with the backlight brightness data BL when the allowed maximum value $BL_{MAX}$ of the backlight brightness data BL is 63.0.

Figure 8:
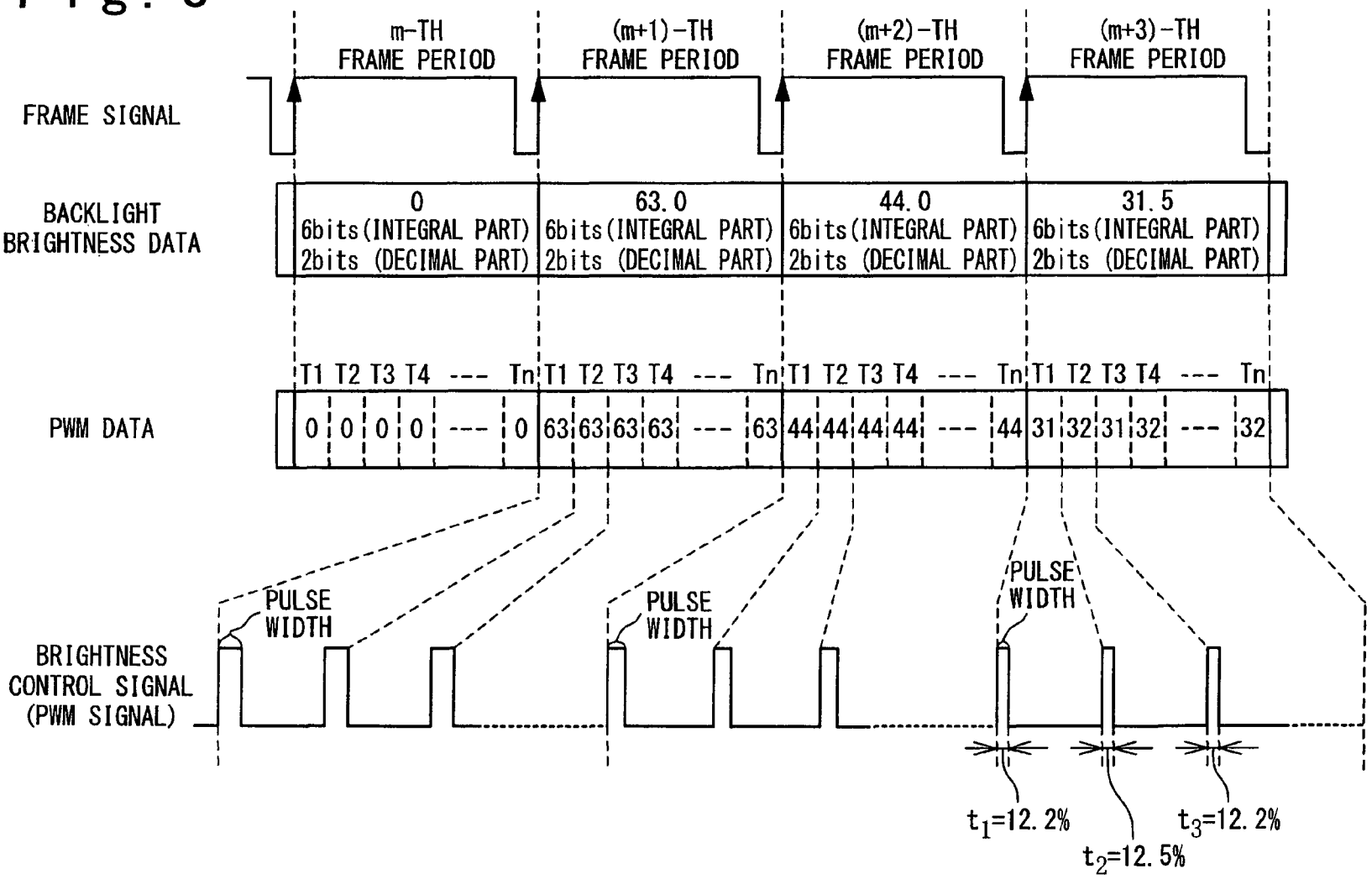
FIG. 8 is a timing chart explaining the control of the back light in the picture level /environment light intensity brightness mode.

In addition, as shown in FIG. 8, each frame period is divided into first to n-th sub-frame periods T1 to Tn (n is a multiple of 4), and the calculation of the PWM data and the control of the duty ratio of the brightness control signal 11 are carried out with a period of a predetermined number of sub-frame periods. In this example, the PWM data $D_{PWM}$ in the first to nth sub-frame periods are calculated by following operation expressions, and thus the control of the duty ratio of the brightness control signal 11 is carried out with a period of four sub-frame periods:

$D_{PWM}=(BL+\text{"00000000"})>>2$ (for the $(4j-3)$-th sub-frame period);

$D_{PWM}=(BL+\text{"00000011"})>>2$ (for the $(4j-2)$-th sub-frame period);

$D_{PWM}=(BL+\text{"00000001"})>>2$ (for the $(4j-1)$-th sub-frame period); and $D_{PWM}=(BL+\text{"00000010"})>>2$ (for the $4j$-th sub-frame period), where j is any natural number of n/4 or less, and the operation ">>2" indicates a 2-bit shift processing. It should be noted that the PWM data $D_{PWM}$ are calculated by this processing as any of integer values of 0 to 63.

In the control of the duty ratio of the brightness control signal 11 in the (m+3)-th frame period in the operational example of FIG. 8, for example, the PWM data are calculated as "31" in the (4j−3)-th sub-frame periods and the (4j−1)-th sub-frame periods, and the PWM data are calculated as "32" in the (4j−2)-th sub-frame periods and the 4j-th sub-frame periods. The duty ratio of the brightness control signal 11 is controlled depending on the calculated PWM data, and thereby the control of the duty ratio of the brightness control signal 11 depending on the backlight brightness data BL including a decimal part, that is, the control of the brightness of the backlight 8 is realized.

In general, when lower k bits of the backlight brightness data BL are allocated to the decimal part, the PWM data are calculated with a period of $2^k$ sub-frame periods. In the above-mentioned example, lower two bits are allocated to the decimal part of the backlight brightness data BL, the PWM data are calculated with a period of four sub-frame periods. By controlling the duty ratio of the brightness control signal 11 in response to the PWM data calculated in this manner, the number of adjustment steps of the brightness of the backlight 8 is virtually increased to $2^k$ times.

It is apparent that the present invention is not limited to the above embodiments, but may be modified and changed without departing from the scope of the invention. For example, the brightness control signal 11 may be generated by the CPU 2. In this case, the brightness control circuit 28 is provided for the CPU 2, and the environment light sensor 6 is connected to the brightness control circuit 28 provided for the CPU 2, while the CPU 2 calculates the APL of the displayed image. It should be noted, however that, the configuration where the brightness control circuit 28 is integrated within the LCD driver 5 allows a commonly-used CPU to be used as the CPU 2 and this configuration is therefore more advantageous.

Additionally, although the above-mentioned embodiments are directed to a liquid crystal display device, the present invention may be applied to a display device that uses a display panel requiring a backlight other than LCD panels.

What is claimed is:

1. A display device, comprising:

a display panel;

a backlight which illuminates said display panel; and a backlight brightness controller controlling a brightness of said backlight such that the brightness of said backlight is variable in the middle of each frame period, wherein said backlight brightness controller is configured to generate a brightness control signal in response to a picture level of an image displayed on said display panel and an environment light intensity, wherein a duty ratio of said brightness control signal is constant during said each frame period when the brightness of said backlight is controlled in response to said picture level independently of said environment light intensity, or controlled in response to said environment light intensity independently of said picture level, wherein said duty ratio of said brightness control signal is variable in the middle of said each frame period when the brightness of said backlight is controlled in response to both of said picture level and said environment light intensity, wherein a brightness control circuit is configured to determine an allowed maximum value of the brightness of said backlight when the brightness of said backlight is controlled in response to both of said picture level and said environment light intensity, wherein said brightness control circuit generates said brightness control signal such that said duty ratio of said brightness control signal is constant during each frame period, when said allowed maximum value is larger than a predetermined threshold value, and wherein said brightness control circuit generates said brightness control signal such that said duty ratio of said brightness control signal is variable in the middle of each frame period, when said allowed maximum value is smaller than said predetermined threshold value.

2. The display device according to claim 1, wherein said brightness control circuit is configured to generate backlight brightness data specifying a desired brightness of said backlight for a whole of a certain frame period, wherein, when the brightness of said backlight is controlled on both of said picture level and said environment light intensity, said brightness control circuit generates PWM data specifying said duty ratio of said brightness control signal in each of a plurality of sub-frame periods defined by dividing said certain frame period so that an average of said PWM data in said certain frame period is equal to said backlight brightness data.

3. The display device according to claim 1, wherein said each frame period is divided into a plurality of sub-frame periods, and wherein the brightness of said backlight is controlled with a period of a predetermined number of sub-frame periods, when the brightness of said backlight is controlled so as to be variable in the middle of said each frame period.

4. The display device according to claim 1, wherein said brightness control circuit is integrated within a display panel driver driving said display panel in response to image data.

5. A display panel driver for driving a display panel, comprising:

a brightness control circuit controlling a brightness of a backlight illuminating said display panel, wherein the brightness of said brightness is variable in the middle of each frame period in a control of the brightness of said backlight by said brightness control circuit, wherein a backlight brightness controller is configured to generate a brightness control signal in response to a picture level of an image displayed on said display panel and an environment light intensity, wherein a duty ratio of said brightness control signal is constant during said each frame period when the brightness of said backlight is controlled in response to said picture level independently of said environment light intensity, or controlled in response to said environment light intensity independently of said picture level, wherein said duty ratio of said brightness control signal is variable in the middle of said each frame period when the brightness of said backlight is controlled in response to both of said picture level and said environment light intensity, wherein said brightness control circuit is configured to determine an allowed maximum value of the brightness of said backlight when the brightness of said backlight is controlled in response to both of said picture level and said environment light intensity, wherein said brightness control circuit generates said brightness control signal such that said duty ratio of said brightness control signal is constant during said each frame period, when said allowed maximum value is larger than a predetermined threshold value, and wherein said brightness control circuit generates said brightness control signal such that said duty ratio of said brightness control signal is variable in the middle of said each frame period, when said allowed maximum value is smaller than said predetermined threshold value.

6. A method of driving a backlight illuminating a display panel, comprising: controlling a brightness of said backlight such that the brightness of said brightness is variable in the middle of each frame period, wherein a backlight brightness controller is configured to generate a brightness control signal in response to a picture level of an image displayed on said display panel and an environment light intensity, wherein a duty ratio of said brightness control signal is constant during said each frame period when the brightness of said backlight is controlled in response to said picture level independently of said environment light intensity, or controlled in response to said environment light intensity independently of said picture level, wherein said duty ratio of said brightness control signal is variable in the middle of said each frame period when the brightness of said backlight is controlled in response to both of said picture level and said environment light intensity, wherein said brightness control circuit is configured to determine an allowed maximum value of the brightness of said backlight when the brightness of said backlight is controlled in response to both of said picture level and said environment light intensity, wherein said brightness control circuit generates said brightness control signal such that said duty ratio of said brightness control signal is constant during said each frame period, when said allowed maximum value is larger than a predetermined threshold value, and wherein said brightness control circuit generates said brightness control signal such that said duty ratio of said brightness control signal is variable in the middle of said each frame period, when said allowed maximum value is smaller than said predetermined threshold value.

7. The method according to claim 6, wherein said each frame period is divided into a plurality of sub-frame periods, and wherein the brightness of said backlight is controlled with a period of a predetermined number of said sub-frame periods, when the brightness of said backlight is controlled so as to be variable in the middle of said each frame period.

* * * * *